US009114290B2

(12) United States Patent
Grant, Jr.

(10) Patent No.: US 9,114,290 B2
(45) Date of Patent: Aug. 25, 2015

(54) GOLF CUP GUARD

(71) Applicant: Robert Treat Grant, Jr., Saint Paul, MN (US)

(72) Inventor: Robert Treat Grant, Jr., Saint Paul, MN (US)

( * ) Notice: Subject to any disclaimer, the term of this patent is extended or adjusted under 35 U.S.C. 154(b) by 0 days.

(21) Appl. No.: 13/783,254

(22) Filed: Mar. 2, 2013

(65) Prior Publication Data

US 2014/0128170 A1 May 8, 2014

Related U.S. Application Data

(60) Provisional application No. 61/796,211, filed on Nov. 5, 2012.

(51) Int. Cl.
*A63B 57/50* (2015.01)
*A63B 57/00* (2015.01)

(52) U.S. Cl.
CPC ..... *A63B 57/0068* (2013.01); *A63B 57/0056* (2013.01)

(58) Field of Classification Search
CPC ..... A63B 57/0056
USPC ..... 473/173–179; 116/222, 173–175
See application file for complete search history.

(56) References Cited

U.S. PATENT DOCUMENTS

| | | | | | |
|---|---|---|---|---|---|
| 1,548,289 | A * | 8/1925 | Sparks | 473/176 |
| 1,599,734 | A * | 9/1926 | Wilson | 473/177 |
| 1,723,859 | A * | 8/1929 | Hummel | 473/176 |
| 1,882,963 | A * | 10/1932 | Scanlan | 473/179 |
| 2,684,245 | A * | 7/1954 | Jacoby | 473/176 |
| 3,772,841 | A * | 11/1973 | Barak et al. | 52/741.1 |
| 3,870,301 | A * | 3/1975 | Brisendine | 473/179 |
| 4,797,305 | A | 1/1989 | Schleicher | |
| 5,228,685 | A * | 7/1993 | Williamson | 473/176 |
| 5,316,292 | A * | 5/1994 | Browne | 172/1 |
| 6,267,688 | B1 * | 7/2001 | Morelli, Sr. | 473/179 |
| 8,272,580 | B1 | 9/2012 | Schoppe | |
| 2004/0092325 | A1 * | 5/2004 | Brown | 473/176 |
| 2008/0102969 | A1 * | 5/2008 | Garske et al. | 473/173 |
| 2008/0171609 | A1 * | 7/2008 | Priegel | 473/176 |
| 2008/0296407 | A1 | 12/2008 | Schleicher | |
| 2009/0280919 | A1 * | 11/2009 | Prince | 473/176 |
| 2010/0331094 | A1 * | 12/2010 | Graves | 473/179 |
| 2011/0269560 | A1 * | 11/2011 | Soper et al. | 473/175 |
| 2012/0024981 | A1 | 2/2012 | Porter | |

* cited by examiner

*Primary Examiner* — Mark Graham
(74) *Attorney, Agent, or Firm* — Nils Peter Mickelson

(57) ABSTRACT

A golf cup guard for placement on a golf cup. The body portion is conical and shaped to prevent material from entering a golf cup. There is a handle to assist in placement and removal of the golf cup guard. The golf cup guard may prevent excess paint, fertilizer, sand, or other materials from falling into the golf cup.

5 Claims, 12 Drawing Sheets

GOLF CUP GUARD

CROSS-REFERENCE TO RELATED APPLICATIONS

This Application claims the benefit of U.S. Provisional Patent Application Ser. 61/796,211 entitled "Cup Cone," filed 2012 Nov. 5.

BACKGROUND OF THE INVENTION

Golf is a sport enjoyed worldwide. It is played on golf courses with various terrain features. In general, the object of golf is to use golf clubs to strike a golf ball into a golf hole in as few strokes as possible. The golf hole is typically located on a carefully maintained golf green, and is defined by the placement of a hole in the ground. Within this hole is inserted a golf cup, often made of metal, which helps to maintain the golf hole's shape and integrity. In the bottom of the hole may also be placed a putting cup assemblage having a ferrule socket shaped to fit a complimentary ferrule on the bottom of a flag stick.

In accordance with the rules of golf, the upper edge of the golf cup sits a fixed distance one inch below the surface of the golf green. Thus, there is a portion of soil between the upper edge of the golf cup and the surface of the green. Since soil is dark in color, the golf hole may be difficult to see from a distance. A common solution to this problem is to paint the soil, typically using white spray paint. In addition, many other materials may be applied to the golf green's surface, for example sand, fertilizer and water. A common problem in the art occurs when unwanted materials such as paint, water, sand, or fertilizer fall into and coat the sides of the golf cup. This combination of materials can create an abrasive mud or a solid aggregate that acts to obstruct the sliding in or out of accessories to the golf cup such as putting cups or flag holders, and can transfer to the golf balls when they fall into the cup.

SUMMARY OF THE INVENTION

A golf cup guard is described. The golf cup guard is configured to prevent materials from entering the golf cup when installed therein. The golf cup guard may rest on the golf cup and has a handle for easy placement and removal.

DETAILED DESCRIPTION OF THE INVENTION

Golf is a sport enjoyed worldwide. It is played on golf courses with various terrain features. In general, the object of golf is to use golf clubs to strike a golf ball into a golf hole in as few strokes as possible. The golf hole is typically on a golf putting green and is defined by the placement of a hole in the ground. In this hole is a golf cup which helps the golf hole maintain its shape and integrity during use.

In accordance with the rules of golf published by the United States Golf Association (USGA), the golf hole must be 4.25 inches (108 mm) in diameter and at least 4 inches (101.6 mm) deep. If a golf cup or a lining is used, its topmost edge must be at least one inch (25.4 mm) below the putting green surface.

This requirement that the golf cup sit at least one inch below the putting surface can make the hole difficult to see from a distance. A common solution to this problem is to paint the soil between the putting surface and the golf cup white. This gives the appearance that the golf cup extends up towards the surface. This is especially helpful when trying to visualize the hole on television, for example during the broadcasting of a golf tournament.

A variety of painting methods may be utilized, including but not limited to spray painting, brush painting, roller painting, etc. A common problem occurs when the paint used to paint the golf hole soil ends up in the golf cup itself. This is possible, for example, if paint drips into the cup or when there is over-spray from a spray paint can. If this paint does not dry prior to the hole being used, the excess paint may adhere to other surfaces that contact the paint, for example a golfer's hand or a golf ball.

Other unwanted materials may fall into the cup. Examples of these materials include materials applied to the putting green's surface or surrounding surfaces. Common examples include, but are not limited to, paint, spray-paint, sand, dirt, topdressing, fertilizer, pesticide, dye, or chemicals applied to grass. Because the grass must be uniformly and meticulously maintained for smoothness and consistency, the immediate sub-soil is often sandy to enhance drainage. The golf cup guard of this invention prevents unwanted materials from entering the cup.

Figure 1:
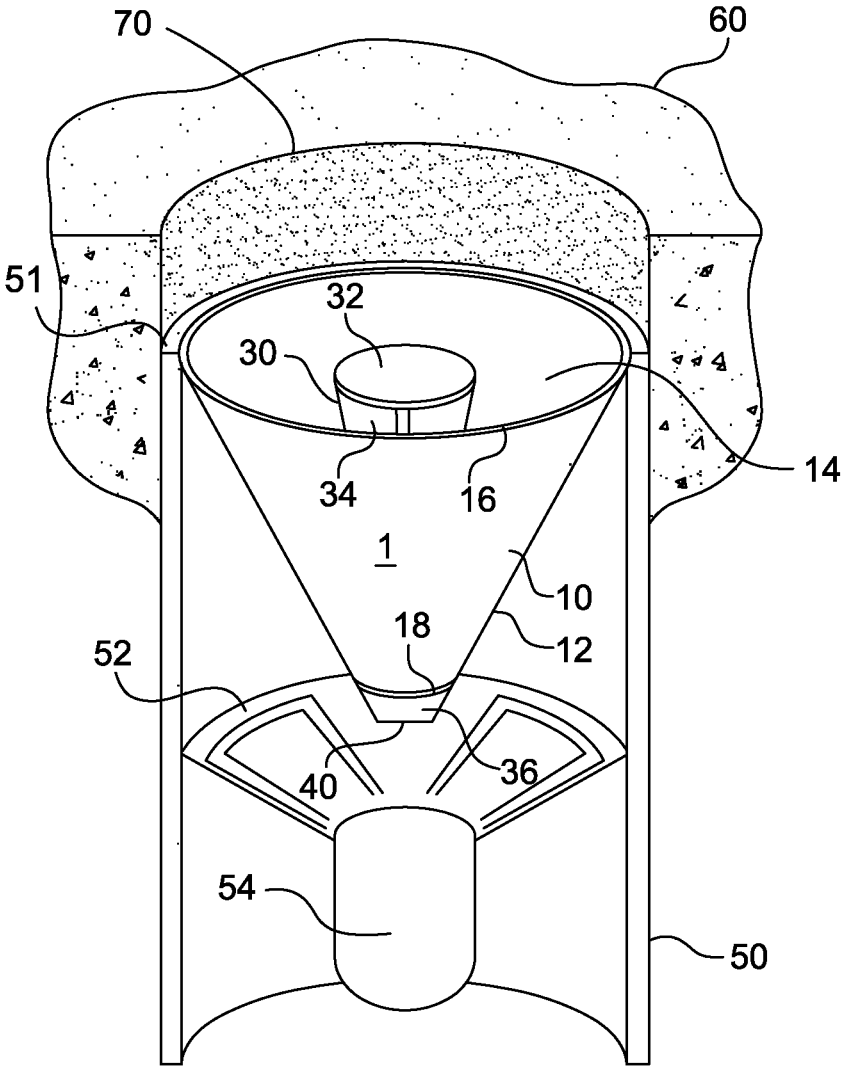
FIG. 1 is a side view of an embodiment of the golf cup guard installed in a typical golf hole containing both a typical golf cup and a putting cup assemblage.

Referring now to the drawings in detail, FIG. 1 illustrates an embodiment of a golf cup guard 1 installed in a typical golf cup. The golf cup guard has a cone-shaped body 10 having an outer surface 12 and an inner surface 14. The conical body is defined by the diameter of its upper rim 16, the diameter of its lower rim 18, and the length of the conical body along its central vertical axis. In general, the diameter of the upper rim 16 is greater than the diameter of the lower rim 18. The lower rim 18 has an inner surface 20 (not shown) having threads 22 (not shown). A handle 30 is attached at the lower rim 18. The handle 30 has a top surface 32 and a body 34 that is generally cylindrical. A lower portion 36 of the handle 30 has threads 38 (not shown). These threads are complementary to threads 22 (not shown) on the inner surface of the lower rim 18. The handle 30 may screw into (and unscrew from) the lower rim 18's inner surface 20. The handle 30 has a bottom surface 40 that may protrude through lower rim 18 as shown. The golf cup guard 1 is shown here resting its upper rim 16 upon the upper edge 51 of a cylindrical golf cup 50 within a golf hole 70 cut into a putting green 60. Also shown here, cylindrical golf cup 50 optionally holds a putting cup assemblage 52 having a flag ferrule socket 54.

The screw-thread attachment between handle 30 and guard 1 is but one embodiment of golf cup guard 1. Other possible attachment methods may comprise a snap-in assembly, a magnetic attachment, or an adhesive attachment. In another embodiment, the golf cup guard 1, including the handle 30, may comprise one unitary part.

Figure 2:
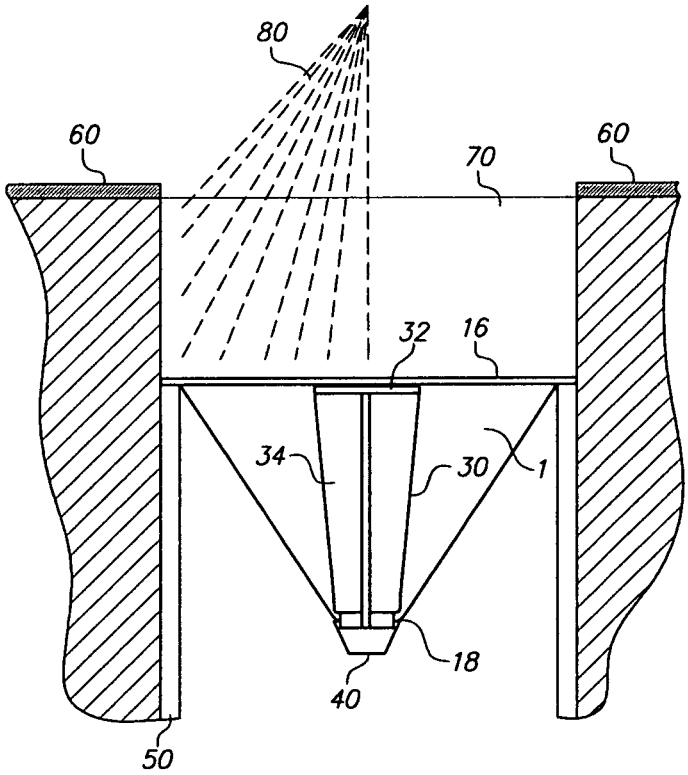
FIG. 2 is a side view of an embodiment of the golf cup guard, illustrating its placement on a golf cup.

FIG. 2 is a cross-section of an embodiment of a golf cup guard 1 deployed above a cylindrical golf cup 50 in a golf hole 70 on a golf green 60. Materials 80 are shown during an application process as the golf cup guard 1 prevents the materials 80 from entering the golf cup 70. The golf cup guard 1 is sized such that the diameter of the upper rim 16 is greater than the inner diameter of the cylindrical golf cup 50. A user may grasp the handle 30 when placing and/or removing the golf cup guard 1.

Figure 3:
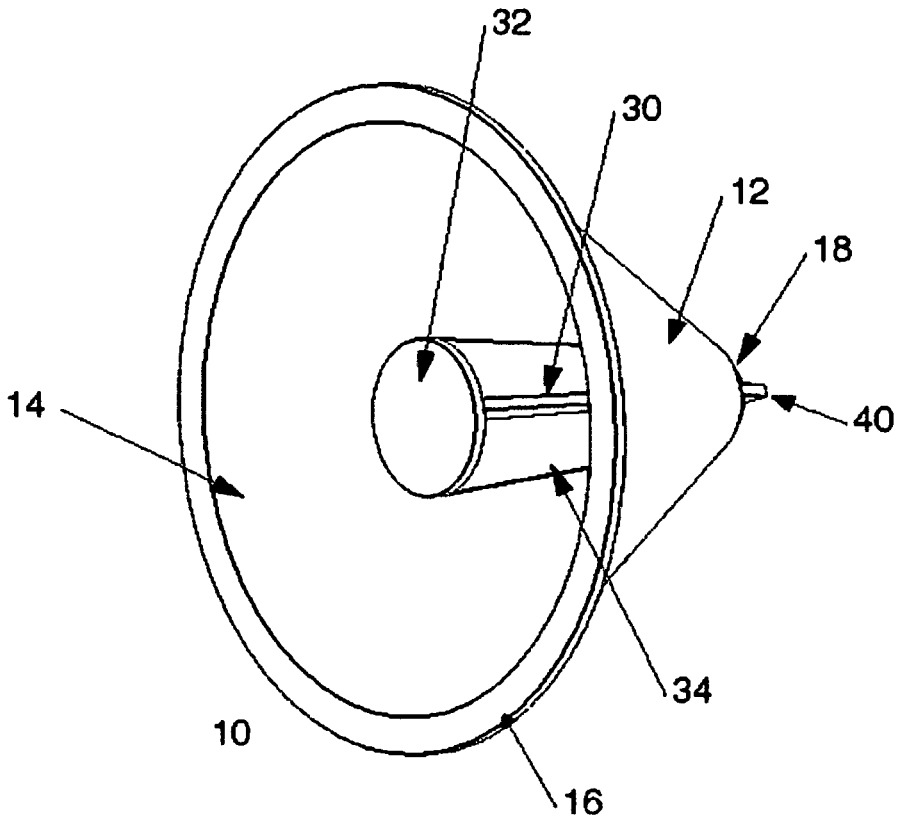
FIG. 3 is a perspective view of an embodiment of the golf cup guard.

FIG. 3 is a perspective view of an embodiment of a golf cup guard 1. The handle 30 has a circular top surface 32. The handle body 34 has an X-shaped cross-section. This cross-sectional shape may facilitate grasping of the handle 30 with fingers.

Figure 4:
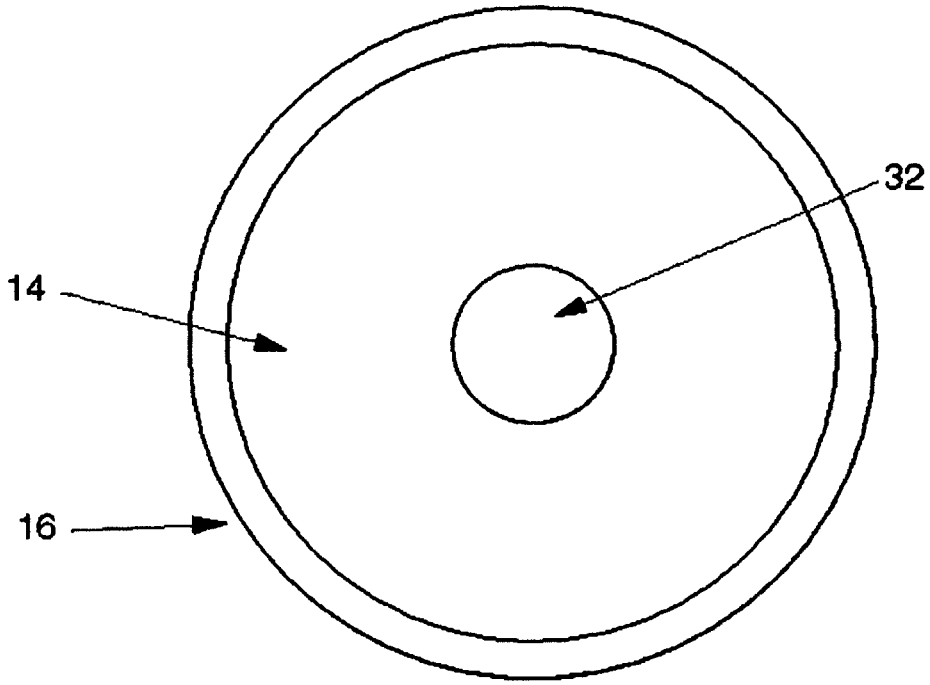
FIG. 4 is a top view of an embodiment of the golf cup guard.

FIG. 4 is a top view of an embodiment of a golf cup guard 1. The inner surface 14 and upper rim 16 of the conical body 10 are shown. The top surface 32 of the handle 30 is visible.

Figure 5:
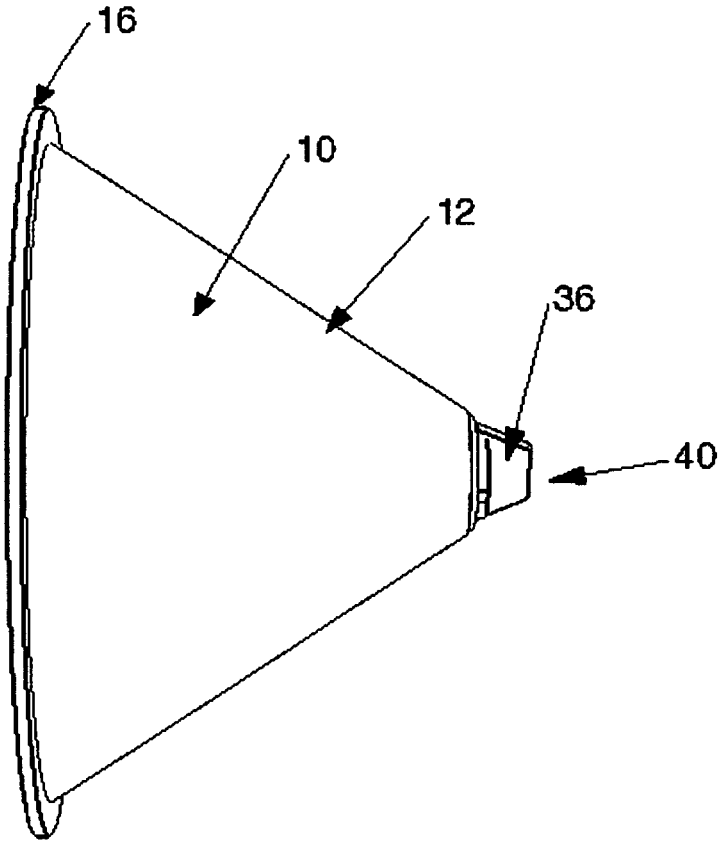
FIG. 5 is a side view of an embodiment of the golf cup guard.

FIG. 5 is a side view of an embodiment of a golf cup guard 1. A lower portion 36 of the handle 30 is visible protruding beyond lower rim 18 of the outer surface 12 of the conical body 10. Also shown is bottom surface 40 of handle 30.

Figure 6:
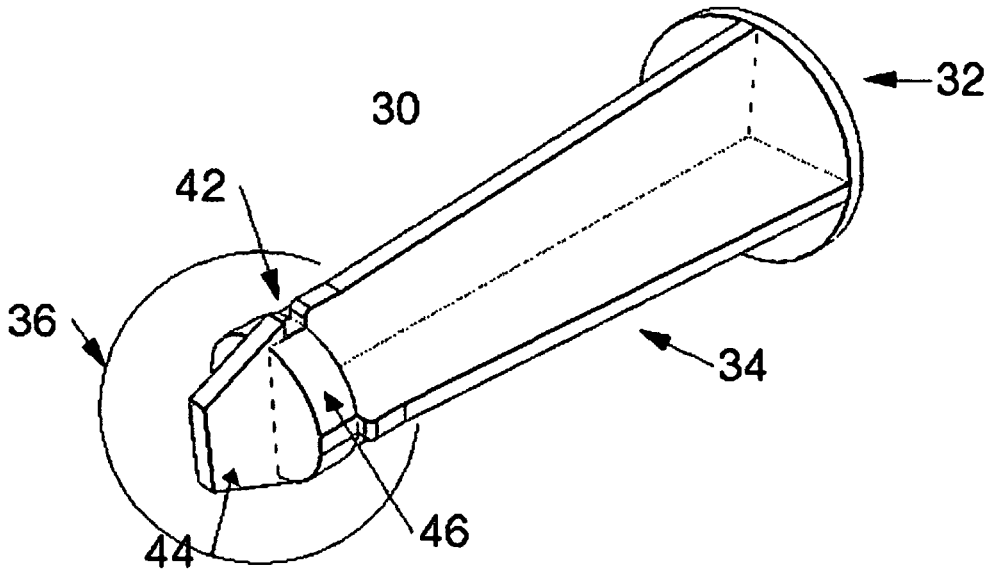
FIG. 6 is a perspective view of an embodiment of the handle of the golf cup guard.

FIG. 6 is a perspective view of an alternate embodiment of handle 30. The handle 30 has a top surface 32 and a body 34 having an X-shaped cross-section. A lower portion 36 of this embodiment has here a snap-in or bayonet-mount mechanism 42 for attaching to golf cup guard 1. The snap-in mechanism 42 is shown with a snap-in tip 44 and a cylindrical spacer 46 on the lower portion 36 of the handle 30. The handle 30 can snap into the lower rim 18's inner surface 20. This snap-in mechanism may be either a one-time locking mechanism (stay in place) or a reversably removable mechanism.

Such a one-time locking mechanism may rely on the lower rim inner surface 20 having a circular cross-section with a fixed diameter. Thus, if the snap-in tip 44 having a slightly larger maximum width is pressed through the fixed diameter of the lower rim inner surface 20, both pieces may deform slightly. If pressed far enough, the snap-in tip 44 will snap irreversibly through the circular cross-section of the lower rim 18's inner surface 20. Thus configured, cylindrical spacer 46 will rest within and seal the lower rim's inner surface 20. Further insertion is prevented by the larger diameter of handle body 34.

Figure 7A:
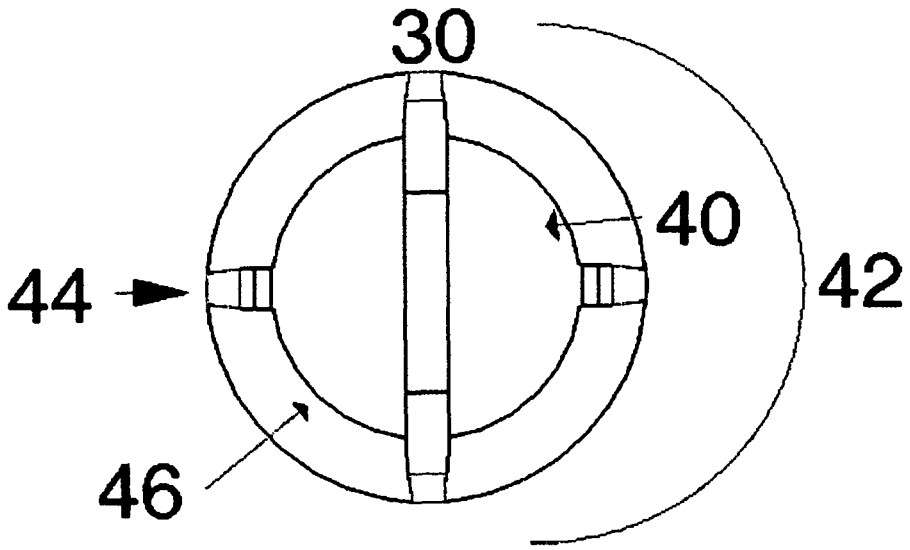
FIG. 7A is a bottom view of an embodiment of the handle of the golf cup guard.

FIG. 7A is a bottom view of an embodiment of a handle 30 having a bottom surface 40. The handle 30 has a snap-in mechanism 42, including a snap-in tip 44 and a cylindrical spacer 46.

Figure 7B:
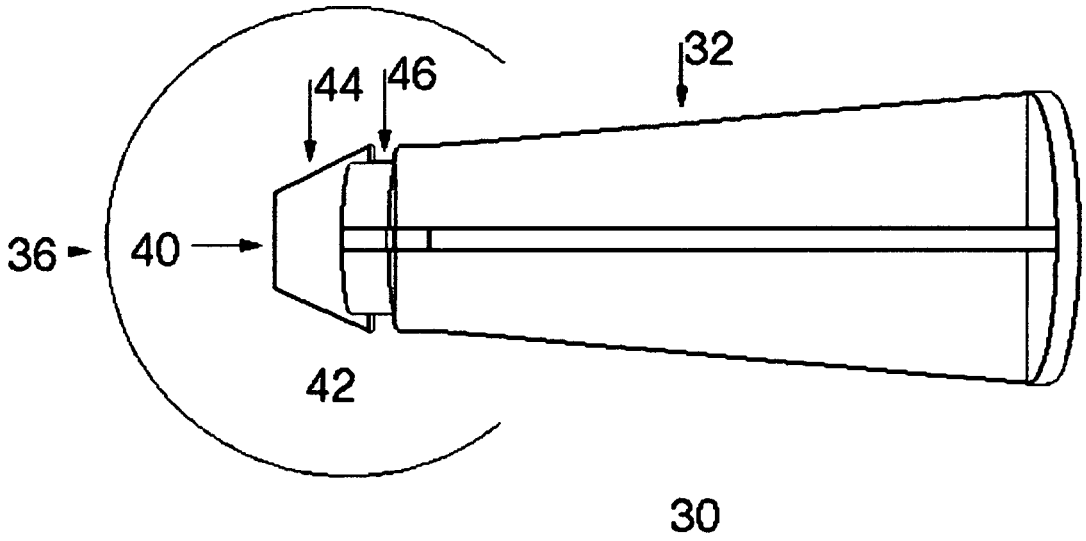
FIG. 7B is a side view of an embodiment of the handle of the golf cup guard.

FIG. 7B is a side view of the same embodiment of handle 30 shown in FIG. 7A having a top surface 32, an X-shaped body 34, and bottom surface 40. The handle 30 shows lower portion 36 which includes snap-in mechanism 42, a snap-in tip 44 and a cylindrical spacer 46.

Figure 8:
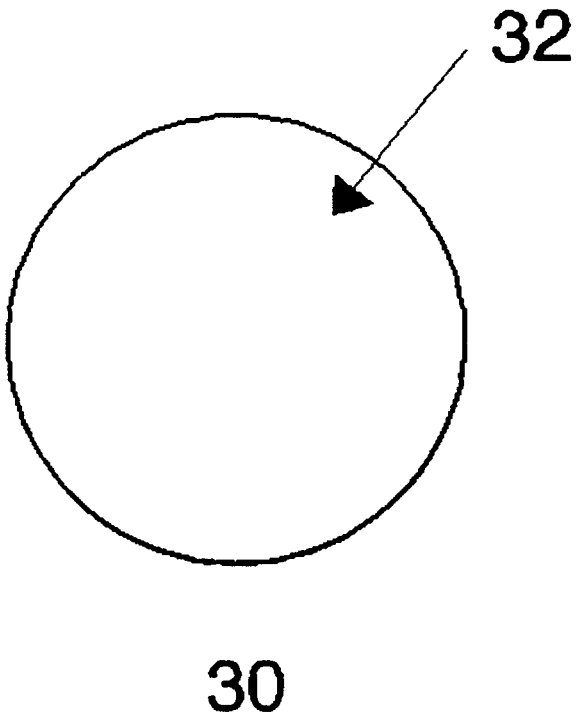
FIG. 8 is a top view of an embodiment of the handle of the golf cup guard.

FIG. 8 illustrates an embodiment of a handle 30 having a top surface 32. The top surface 32 is solid and circular.

Figure 9A:
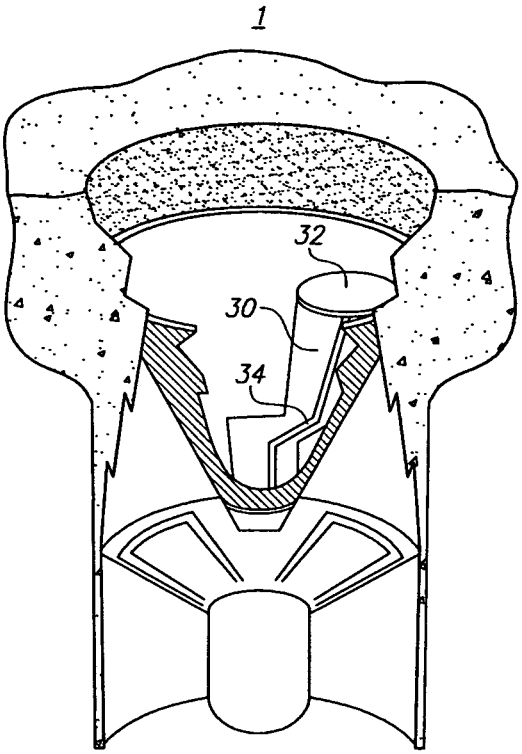
FIG. 9A is a perspective view of an embodiment of the golf cup guard in a golf hole, illustrating an offset jagged embodiment of the handle.

FIG. 9A illustrates an embodiment of a golf cup guard 1 having a handle 30 which is offset from its central axis. This handle 30 shows a top surface 32 and a jagged handle body 34.

Figure 9B:
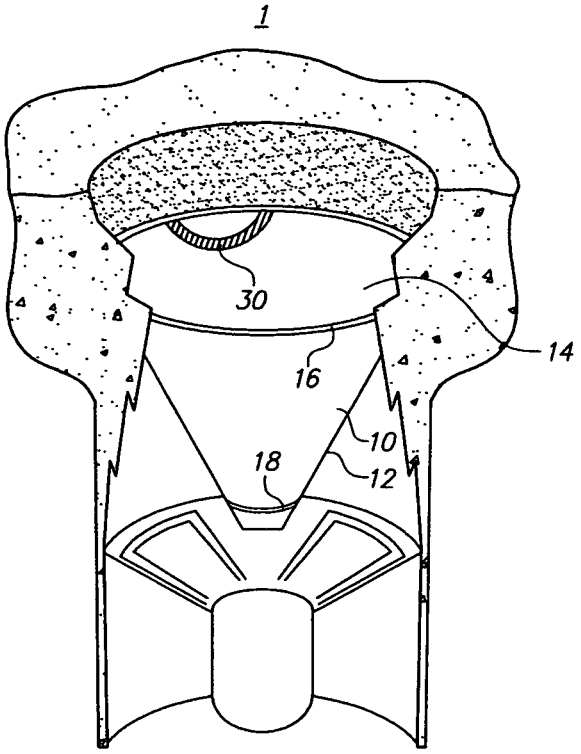
FIG. 9B is a perspective view of an embodiment of the golf cup guard in a golf hole, illustrating a loop embodiment of the handle.

FIG. 9B illustrates an embodiment of a golf cup guard 1 having a handle 30 which comprises a loop structure rigidly or flexibly attached to the upper rim 16 of the conical body 10.

Figure 9C:
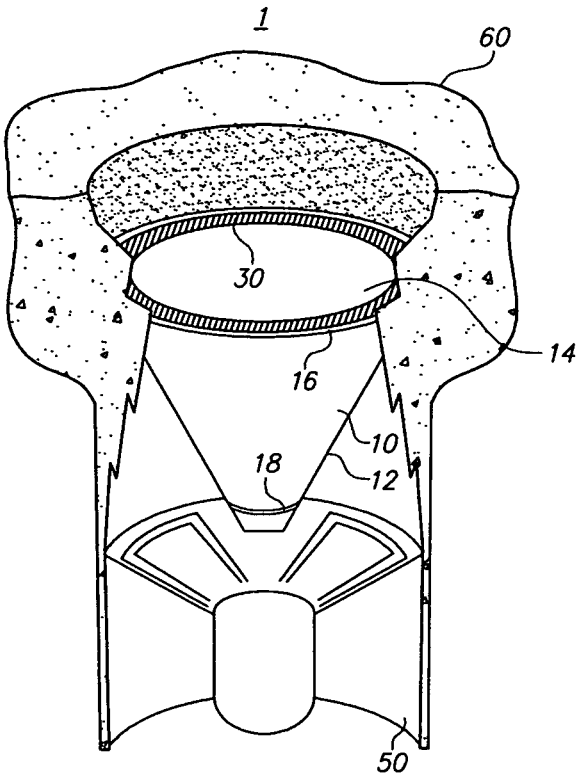
FIG. 9C is a perspective view of an embodiment of the golf cup guard in a golf hole, illustrating an edge embodiment of the handle.

FIG. 9C illustrates an embodiment of a golf cup guard 1 having a handle structure 30 which comprises a rolled bead structure with an outer diameter not exceeding the outer diameter of upper rim 16 and an inner diameter such that the bead provides a rounded inward overhang at the top of the golf cup guard 1. This inward overhang forms the handle structure 30, such that a user may grasp this inward overhang when deploying or removing the golf cup guard 1.

In accordance with this invention, a golf cup guard 1 may be constructed from any suitable material or combination of materials, for example plastic, metal, or wood. Suitable plastic materials include nylon and polypropylene. Suitable metal materials include aluminum, steel, stainless steel, and titanium. If the user desires a magnetic handle connection, ferrous materials such as iron would be suitable. The golf cup guard 1 may be manufactured by a molding process. Examples include plastic molding processes, metallic casting processes, or additive manufacturing (for example 3D-printing).

In one embodiment, the guard may have an axial length of 2.5 inches, an outer diameter of the upper rim 16 of 4.16 inches, an outer diameter at the lower rim 18 of 0.72 inches, and an inner diameter of the lower rim 18 of 0.52 inches. The handle 30 may be 2.6 inches in total length. The top surface of the handle 32 may have a 1-inch diameter. The handle 30 may attach to the conical body 10 at the inner surface 20 of its lower rim 18.

The handle 30 may also attach via a screw-thread mechanism. For example, female threads 22 on inner surface 20 of the lower rim 18 may engage with complementary male threads 38 on the lower portion 36 of the handle. In an alternative attachment embodiment, a snap-in mechanism 42 on the lower portion 36 of the handle 30 engages with a complementary snap-in mechanism on the inner surface 20 of the lower rim 18. The inner diameter of this lower rim 18 of conical body 10 may be 0.52 inches. The handle 34's snap-in tip 44 may be tapered, having a lower end dimension of 0.33 inches and an upper dimension of 0.64 inches. The snap-in mechanism 42 may also include a cylindrical spacer 46 having a diameter matching the lower rim 18 of conical body 10, in this example 0.52 inches. Engagement of this cylindrical spacer 46 within lower rim 18 effects to fully close the bottom of the cone-shaped body 10, preventing any detritus from falling into the guarded golf hole, as do the engaged complementary screw threads 22 and 38 of the threaded attachment embodiment. Above the snap-in mechanism 42 or the mating screw threads 22 and 38, the handle body 34 may taper outward from its lower dimension of 0.64 inches to the handle 30's outer diameter.

In an alternative embodiment, the guard 1 may also be configured to be inverted on the handle, such that guard 1 sits upside down (narrow end upwards) on the upper edge of golf cup 50. This inverted position may be useful for guarding the cup from fertilizer or other materials. Thus inverted, the installer need not reach down so far. In such a configuration, the handle may be removable (for example if magnetically attached) or may be stored underneath and within the conical body 10 if so desired.

A user may grasp the golf cup guard and place it inside a golf hole on top of the golf cup. The user may then apply materials to the hole and its nearby surroundings. Example applications include painting the soil above the golf cup and applying materials to the green or surrounding surfaces. Common example materials may include, but are not limited to, paint, spray-paint, sand, dirt, top-dressing, fertilizer, pesticide, dye, or chemicals applied to the grass. The golf cup guard prevents these unwanted materials from entering and spoiling the cup. The user may then grasp the golf cup guard by its handle means and freely remove it from the hole.

The golf cup guard would contain excess material that it prevented from entering the cup, and the user may discard this excess material in an appropriate receptacle or space.

I claim:

1. A guard for use on a golf hole cup, said guard comprising both a guard body and a handling means fastened to said guard body, said guard body being an inverted frustum of a hollow cone, defining thereby its larger open top end diameter and its opposite smaller open bottom end diameter;

said larger open end diameter selected to be large enough to rest securely upon the top rim of said golf hole cup, yet small enough to fit freely down within a golf hole within which said golf hole cup is installed;

said smaller open end diameter selected to be large enough to permit a flag pole ferrule to pass therethrough; and said handling means fastened to said guard body at said larger open top end diameter;

whereby said guard, fastened to said handling means, may be dropped into and freely removed from within a golf hole by use of said handling means, collecting foreign objects and material that enter said golf hole into said guard, and thereby protecting said golf hole cup from the intrusion or adhesion of any foreign material.

2. The guard of claim 1 wherein said handling means is a finger loop hingedly fastened to said guard body at said larger open top end diameter.

3. The guard of claim 1 wherein said handling means is a rounded grasping bead fastened and extending entirely around the entire circumference of said larger open top end diameter.

4. The guard of claim 1 whereby said guard may be removed from said cup by lifting on said handling means with fingers.

5. A guard for use on a golf hole cup, said guard comprising both a guard body and a handling means fastened to said guard body, said guard body being an inverted frustum of a hollow cone, defining thereby its larger open top end diameter and its opposite smaller open bottom end diameter;

said larger open end diameter selected to be large enough to rest securely upon the top rim of said golf hole cup, yet small enough to fit freely down within a golf hole within which said golf hole cup is installed; and said smaller open end diameter selected to be large enough to permit a flag pole ferrule to pass therethrough, and said handling means fastened to said guard body at said smaller open end diameter and aligned at an angle to the axis of said guard body.

* * * * *